US007497437B2

(12) United States Patent
Kondo et al.

(10) Patent No.: US 7,497,437 B2
(45) Date of Patent: Mar. 3, 2009

(54) SHEET GUIDE APPARATUS

(75) Inventors: Hayato Kondo, Ibaraki (JP); Takeshi Asai, Ibaraki (JP)

(73) Assignee: Komori Corporation, Tokyo (JP)

( * ) Notice: Subject to any disclaimer, the term of this patent is extended or adjusted under 35 U.S.C. 154(b) by 138 days.

(21) Appl. No.: 11/311,965

(22) Filed: Dec. 19, 2005

(65) Prior Publication Data

US 2006/0181013 A1 Aug. 17, 2006

(30) Foreign Application Priority Data

Dec. 21, 2004 (JP) ..... 2004-368999

(51) Int. Cl.
*B65H 5/04* (2006.01)

(52) U.S. Cl. ..... 271/275; 271/277; 271/264; 271/314; 101/232

(58) Field of Classification Search ..... 271/264, 271/204, 314, 176, 275, 271; 101/232
See application file for complete search history.

(56) References Cited

U.S. PATENT DOCUMENTS 5,730,055 A 3/1998 Dopke et al.
5,816,155 A * 10/1998 Stephan ..... 101/232
2003/0189286 A1* 10/2003 Shimizu et al. ..... 271/264
2004/0154491 A1 8/2004 Stephan et al.

FOREIGN PATENT DOCUMENTS

EP 0 695 715 A1 2/1996
JP 2004-137028 5/2004
JP 2004-137028 A 5/2004

* cited by examiner

*Primary Examiner*—Patrick H Mackey
*Assistant Examiner*—Luis Gonzalez
(74) *Attorney, Agent, or Firm*—Blakely, Sokoloff, Taylor & Zafman

(57) ABSTRACT

A sheet guide apparatus includes a transfer cylinder, delivery chains, and sheet guide structure. The transfer cylinder holds a sheet. The delivery chains hold the sheet received from the transfer cylinder and conveys the sheet along a first convey path which is at least substantially arcuate. The sheet guide structure guides the sheet conveyed by the delivery chains. The sheet guide structure includes a movable guide member and stationary guide member. The movable guide member is movable between positions close to and spaced apart from the first convey path. The stationary guide member is stationarily arranged at a position spaced apart from the first convey path. When the movable guide member is close to the first convey path, a thin-sheet guide surface having a continuous substantially arcuate section is formed by only the movable guide member. When the movable guide member is spaced apart from the first convey path, a thick-sheet guide surface having a continuous substantially arcuate section is formed by the movable and stationary guide members.

12 Claims, 5 Drawing Sheets

SHEET GUIDE APPARATUS

BACKGROUND OF THE INVENTION

The present invention relates to a sheet guide apparatus which is connected to a printing press for printing a sheet, a coating machine for coating the sheet, or the like, and conveys the sheet in a stable state.

Generally, in a delivery device for a sheet-fed perfecter, a sheet guide member is arranged around a delivery cylinder to prevent rubbing or wrinkles which cause a printing trouble during sheet conveyance. To convey a sheet in a stable state, the sheet guide member blows air in a direction perpendicular to the sheet convey direction. In the conventional sheet guide apparatus which has the above arrangement, problems occur when a so-called thick sheet having a relatively large thickness is to be conveyed around the delivery cylinder. More specifically, because the thick sheet does not flex readily and is heavy, a large centrifugal force is generated to bring the printing surface on the reverse side of the trailing edge of the sheet into contact with the sheet guide member to damage or rub the printing surface.

In order to prevent these problems, if the gap between the outer surface of the delivery cylinder and the sheet guide member is increased, the Venturi effect obtained by the air blown from the sheet guide member decreases. When a so-called thin sheet having a relatively small thickness is to be conveyed, instability occurs to the sheet to damage or rub the printing surface.

As a countermeasure to solve these problems, as shown in Japanese Patent Laid-Open No. 2004-137028, a structure is proposed in which the distal end of the sheet guide member upstream in the sheet convey direction is movable between positions close to and spaced apart from the delivery cylinder. In this structure, when a thin sheet is to be conveyed, the distal end of the sheet guide member upstream in the sheet convey direction is moved close to the delivery cylinder. When a thick sheet is to be conveyed, the distal end of the sheet guide member upstream in the sheet convey direction is spaced apart from the delivery cylinder.

In the conventional sheet guide apparatus proposed in the above reference, when the distal end of the sheet guide member upstream in the sheet convey direction is positioned spaced apart from the delivery cylinder in order to convey a thick sheet, that portion of the sheet guide member which is downstream in the sheet convey direction stays close to the delivery cylinder. Therefore, when the thick sheet is to be gripped and conveyed by the grippers of the delivery cylinder, the trailing edge of the thick sheet which is to be spaced apart from the delivery cylinder is brought into contact with the inner surface of the sheet guide member downstream in the sheet convey direction by the centrifugal force to damage or rub the printing surface on the reverse side of the sheet.

SUMMARY OF THE INVENTION

It is an object of the present invention to provide a sheet guide apparatus which prevents the printing surface of a sheet from being damaged or rubbed when the sheet has a different thickness or weight.

In order to achieve the above object, according to the present invention, there is provided a sheet guide apparatus comprising a transport cylinder which holds and conveys a sheet, convey means for holding the sheet received from the transport cylinder and conveying the sheet along a first convey path which is at least substantially arcuate, and a sheet guide structure which guides the sheet conveyed by the convey means, the sheet guide structure comprising movable guide means which is movable between positions close to and spaced apart from the first convey path and stationary guide means which is stationarily arranged at a position spaced apart from the first convey path, wherein when the movable guide means is close to the first convey path, a first guide surface having a continuous substantially arcuate section is formed by only the movable guide means, and when the movable guide means is spaced apart from the first convey path, a second guide surface having a continuous substantially arcuate section is formed by the movable guide means and the stationary guide means.

DESCRIPTION OF THE PREFERRED EMBODIMENTS

Figure 2:
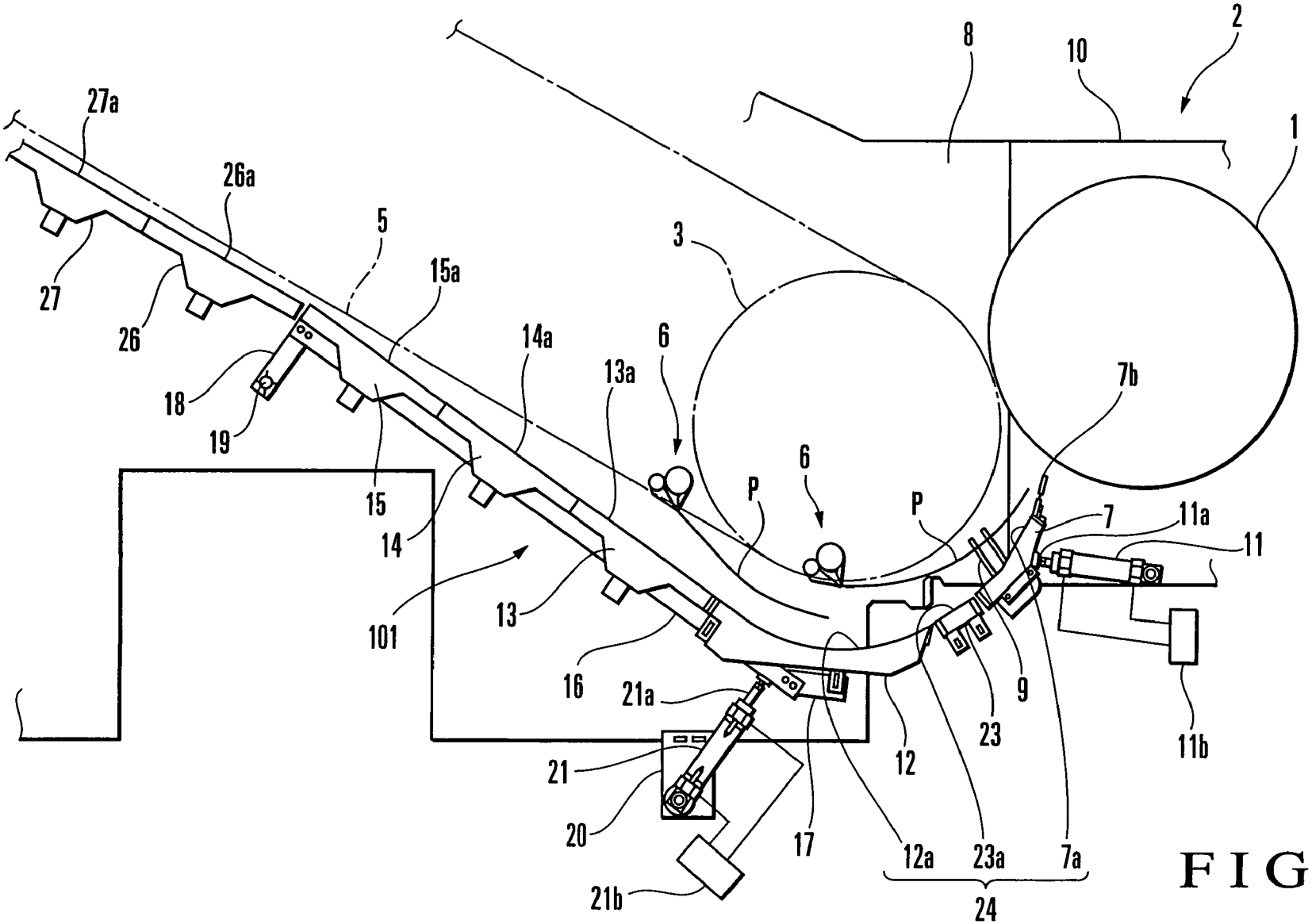
FIG. 2 is a side view showing a state wherein the sheet guide apparatus shown in FIG. 1 guides a thick sheet.
Figure 3:
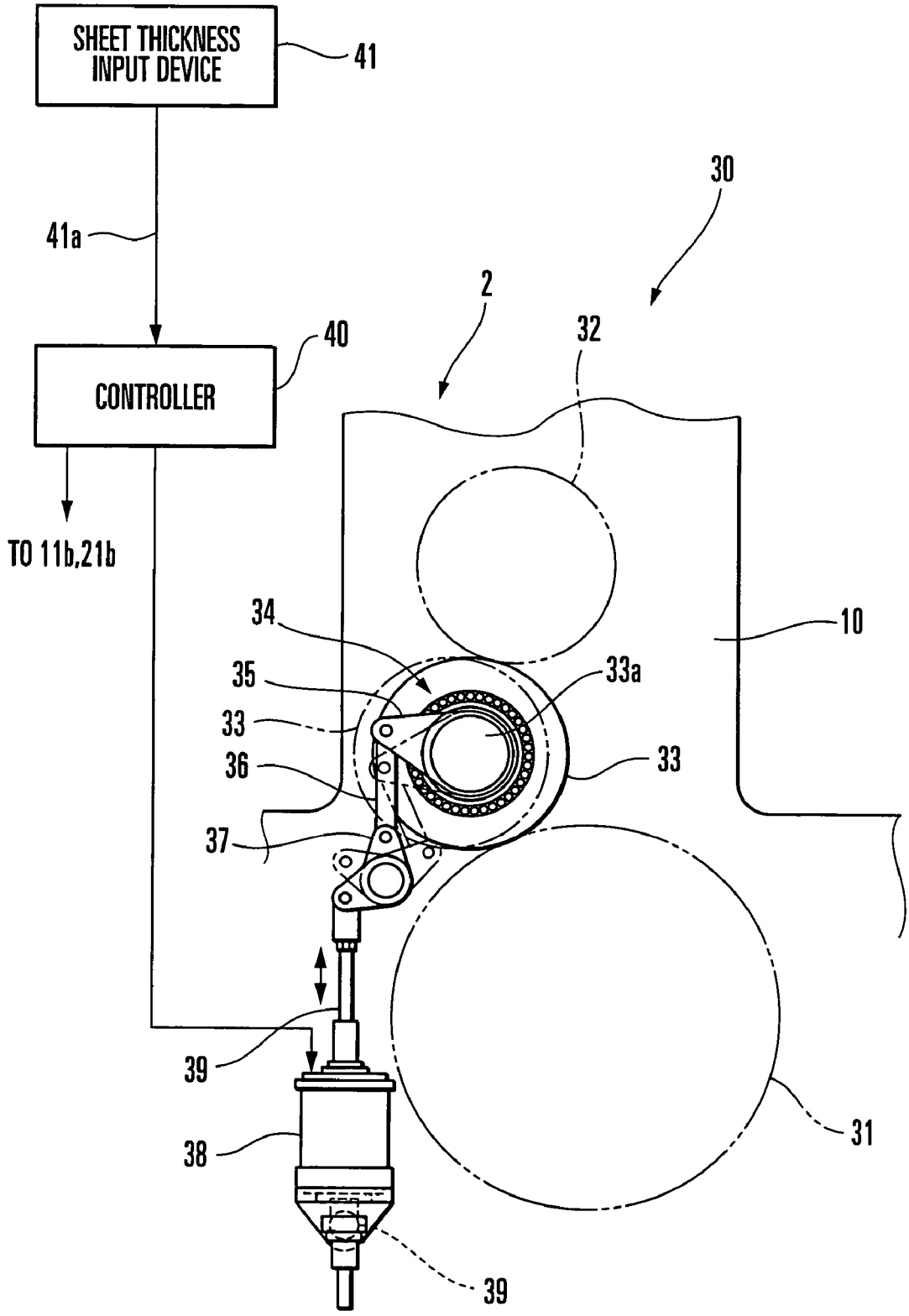
FIG. 3 is a side view of a cylinder throw on/off mechanism portion in the sheet guide apparatus shown in FIG. 1.

A sheet guide apparatus according to the first embodiment of the present invention will be described with reference to FIGS. 1 to 3. A printing unit 2 of a sheet-fed perfecter comprises a plurality of printing units (not shown) corresponding to different colors. A transfer cylinder 1 serving as a transport cylinder is arranged at the final end of a cylinder group that forms the final printing unit. A delivery cylinder 3 which forms an arcuate convey path is arranged to oppose the transfer cylinder 1. A pair of delivery chains 5 (one delivery chain is not shown) serving as a convey means are looped around a sprocket (not shown) coaxial with the delivery cylinder 3 and a sprocket (not shown) at the rear end of a delivery unit 4 of the sheet-fed perfecter.

A plurality of gripper bars (not shown) are supported between the pair of delivery chains 5 at a constant interval in a traveling direction A of the delivery chains 5. A plurality of delivery grippers 6 each comprising a gripper and gripper pad line up on each gripper bar at a constant interval in the longitudinal direction of the gripper bar (widthwise direction of the sheet). A first movable guide member 7 extends downstream of the delivery cylinder 3 in the sheet convey direction from near the downstream side of a point B where the transfer cylinder 1 and delivery cylinder 3 oppose. The first movable guide member 7 has a guide surface 7*a* with an arcuate section having substantially the same curvature as that of the outer surface of the opposing delivery cylinder 3.

The first movable guide member 7 is supported by guide rails 9 attached to delivery frames 8 to be movable between positions close to and spaced apart from the delivery cylinder 3 (arcuate convey path). The distal end of a rod 11*a* of a first air cylinder 11 having a pivotally mounted cylinder end is pivotally mounted on frames 10 of the printing unit 2. The air cylinder 11 is driven by a solenoid valve unit 11*b* which switches between supply and discharge of pressurized air.

Figure 1:
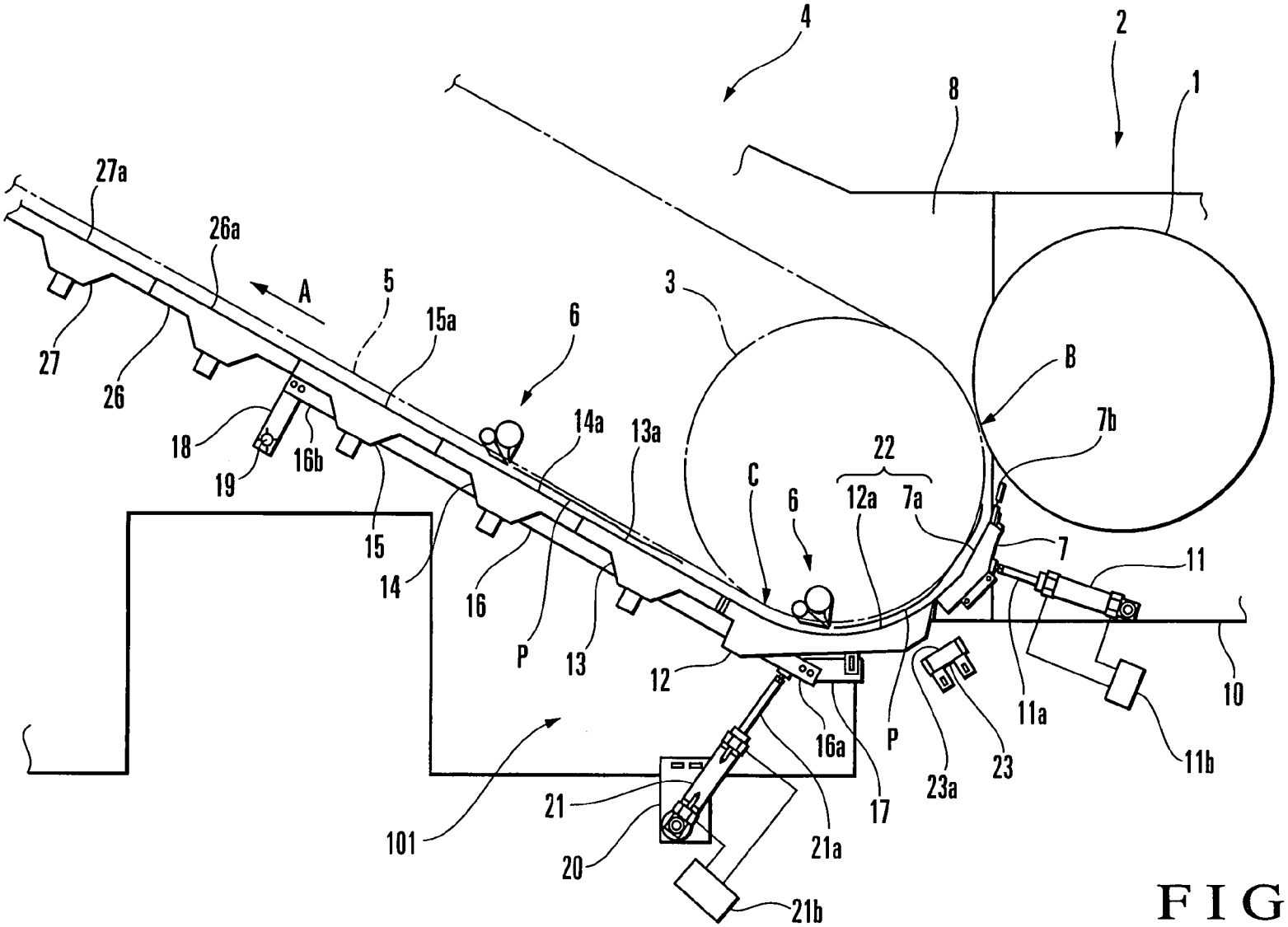
FIG. 1 is a side view showing a state wherein a sheet guide apparatus according to the first embodiment of the present invention guides a thin sheet.

In this arrangement, when the rod 11*a* of the air cylinder 11 moves forward, the guide surface 7*a* of the first movable guide member 7 opposes the delivery cylinder 3 to be close to it, as shown in FIG. 1. When the rod 11*a* of the air cylinder 11 moves backward, the guide surface 7*a* of the first movable guide member 7 opposes the delivery cylinder 3 to be spaced apart from it, as shown in FIG. 2. In this state, a downstream end 7*b* in the sheet convey direction of the first movable guide member 7 moves close to the transfer cylinder 1.

A second movable guide member 12 extends downstream of the first movable guide member 7 in the sheet convey direction to be adjacent to it. The second movable guide member 12 has a guide surface 12*a* with an arcuate section having substantially the same curvature as that of the outer surface of the opposing delivery cylinder 3. Linear guide members 13, 14, and 15 are sequentially arranged downstream of the second movable guide member 12 in the sheet convey direction to be adjacent to it. The linear guide members 13, 14, and 15 are connected to each other by a movable lever 16 fixed to their lower surfaces. The second movable guide member 12 is supported by one end 16*a* of the movable lever 16 which is upstream in the sheet convey direction through a support plate 17. The first and second movable guide members 7 and 12 and linear guide members 13, 14, and 15 form a movable guide means. The second movable guide member 12 and linear guide members 13, 14, and 15 may be integral.

The distal end of a rod 21*a* of a second air cylinder 21 is pivotally mounted on the end 16*a* of the movable lever 16. A downstream end 16*b* of the movable lever 16 in the sheet convey direction is swingably attached to the delivery frames 8 by a pivot shaft 19 through a swing lever 18. The cylinder end of the air cylinder 21 is attached to the delivery frames 8 through a bracket 20. The air cylinder 21 is driven by a solenoid valve unit 21*b* which switches between supply and discharge of the pressurized air.

In this arrangement, when the rod 21*a* of the air cylinder 21 moves forward, guide surfaces 13*a*, 14*a*, and 15*a* of the linear guide members 13, 14, and 15 oppose the delivery chains 5 to be close to them, as shown in FIG. 1. Simultaneously, the guide surface 12*a* of the second movable guide member 12 opposes the outer surface of the delivery cylinder 3 to be close to it.

Hence, the second movable guide member 12 is adjacent to the first movable guide member 7 which is close to the delivery cylinder 3, and the guide surfaces 7*a* and 12*a* form a thin-sheet guide surface 22 having a continuous substantially arcuate section. The thin-sheet guide surface 22 opposes the outer surface of the delivery cylinder 3 to be close to it between a position near the opposing point B of the transfer cylinder 1 and delivery cylinder 3 and a point C where the delivery chains 5 start to separate from the sprocket.

When the rod 21*a* of the air cylinder 21 moves backward from the state of FIG. 1, the movable lever 16 pivots in a direction (clockwise in FIG. 1) to separate from the delivery cylinder 3 about the pivot shaft 19 as the center. Then, the guide surfaces 13*a*, 14*a*, and 15*a* of the linear guide members 13, 14, and 15 separate from the delivery chains 5 (linear convey path) to be gradually farther from them, as shown in FIG. 2, and the guide surface 12*a* of the second movable guide member 12 opposes the outer surface of the delivery cylinder 3 to be spaced apart from it.

At those positions of the delivery frames 8 which are spaced apart from the delivery cylinder 3, a stationary guide member 23 having a stationary guide surface 23*a* with an arcuate section having substantially the same curvature as that of the outer surface of the opposing delivery cylinder 3 is attached through a bracket (not shown). The stationary guide surface 23*a* may alternatively be a flat surface. As shown in FIG. 2, when both the first and second movable guide members 7 and 12 are spaced apart from the delivery cylinder 3, the stationary guide member 23 is located between the first and second movable guide members 7 and 12. In this state, the stationary guide surface 23*a* together with the guide surfaces 7*a* and 12*a* of the first and second movable guide members 7 and 12 forms a thick-sheet guide surface 24 having a continuous substantially arcuate section. At this time, the thick-sheet guide surface 24 opposes the outer surface of the delivery cylinder 3 to be spaced apart from it.

Linear guide members 26 and 27 are sequentially attached to the delivery frames 8 further downstream of the linear guide member 15 in the sheet convey direction to be adjacent to it. The linear guide members 26 and 27 oppose the pair of delivery chains 5 to be close to them and have flat guide surfaces 26*a* and 27*a*, respectively. The movable guide members 7 and 12 to 15, stationary guide member 23, and linear guide members 26 and 27 form a sheet guide structure 101.

Switching control between thick and thin sheets will be explained. The switching control is interlocked with control of adjusting the gap between the impression cylinder and blanket cylinder. In a cylinder throw on/off mechanism 30 shown in FIG. 3, an impression cylinder 31 and plate cylinder 32 which form the printing unit 2 of the sheet-fed perfecter are rotatably supported at a predetermined gap by the pair of frames 10. A blanket cylinder 33 is arranged between the two cylinders 31 and 32. Two end shafts 33*a* of the blanket cylinder 33 are supported by the pair of frames 10 through a pair of eccentric bearings 34 each having inner and outer races with eccentric shaft cores. A bearing lever 35 is fixed to the outer race of each eccentric bearing 34. The bearing lever 35 is connected to a driving rod 39 of a stepping motor 38 which is supported by the frames 10 through a connection lever 36 and 37 to extend vertically. A controller 40 performs drive control of the stepping motor 38 based on an input sheet thickness signal 41*a*.

In this arrangement, when the stepping motor 38 rotates to rotate a nut 39, the driving rod 39 engaging with the nut 39 vertically moves to pivot the eccentric bearings 34. Thus, switching is performed between an impression throw-on position (a position indicated by a solid line in FIG. 3) where the blanket cylinder 33 at a position corresponding to the sheet thickness is in contact with the impression cylinder 31 and plate cylinder 32 and an impression throw-off position (a position indicated by an alternate long and two short dashed line) where the blanket cylinder 33 is spaced apart from the impression cylinder 31.

When the controller 40 receives the sheet thickness signal 41*a* from a sheet thickness input device 41, the controller 40 calculates the gap between the blanket cylinder 33 and impression cylinder 31 corresponding to the sheet thickness, i.e., the stop position of the driving rod 39, and determines the rotational speed of the stepping motor 38. At this time, the controller 40 compares the sheet thickness indicated by the sheet thickness signal 41*a* with a preset threshold (e.g., 0.2 mm). If the sheet thickness signal 41*a* is larger than the threshold, the controller 40 determines that the sheet is a thick sheet. If the sheet thickness signal 41*a* is smaller than the threshold, the controller 40 determines that the sheet is a thin sheet. When the sheet is determined as a thick sheet, the controller 40 controls the solenoid valve units 11*b* and 21*b* to move the rods 11*a* and 21*a* of the air cylinders 11 and 21 backward. When the sheet is determined as a thin sheet, the controller 40 controls the solenoid valve units 11*b* and 21*b* to move the rods 11*a* and 21*a* of the air cylinders 11 and 21 forward.

Sheet guide operation in the sheet guide apparatus having the above arrangement will be described. Prior to printing operation, when the operator inputs the thickness of a sheet P to the sheet thickness input device 41 prior to printing, a sheet thickness signal 41*a* indicating a thin sheet is input to the controller 40. The controller 40 determines the rotational speed of the stepping motor 38 in accordance with the input sheet thickness signal 41*a*, to move the driving rod 39 forward or backward into and from the gap between the blanket cylinder 33 and impression cylinder 31 corresponding to the sheet thickness.

Simultaneously, the controller 40 checks whether the sheet P is a thick sheet or thin sheet based on the input sheet thickness signal 41*a*. When the sheet P is determined to be a thin sheet, the controller 40 controls the solenoid valve units 11*b* and 21*b* to move the rods 11*a* and 21*a* of the air cylinders 11 and 21 forward. Thus, the guide surfaces 7*a* and 12*a* of the first and second movable guide members 7 and 12 oppose the outer surface of the delivery cylinder 3 to be close to it, as shown in FIG. 1. Also, the guide surface 14*a* of the linear guide member 14 opposes the delivery chains 5 to be close to them.

At this time, the first and second movable guide members 7 and 12 are adjacent to each other, and the two guide surfaces 7*a* and 12*a* form the thin-sheet guide surface 22 having a continuous substantially arcuate section. The thin-sheet guide surface 22 opposes the outer surface of the delivery cylinder 3 to be close to it between the position near the opposing point B of the transfer cylinder 1 and delivery cylinder 3 and the point C where the sprocket and delivery chains start to separate. The first and second movable guide members 7 and 12 and linear guide members 13, 14, and 15 blow air from their nozzle holes (not shown) in a direction (widthwise direction of the sheet P) perpendicular to the convey direction A of the sheet P.

In this state, when the printing operation is started, the sheet (thin sheet) P passes between the impression cylinders 31 and blanket cylinders 33 of the plurality of printing units of the printing unit 2 to be subjected to double-sided printing. After the printing, the sheet P is conveyed as it is gripped by the grippers of the transfer cylinder 1 located at the final end of the printing unit 2, and gripping-changed to the delivery grippers 6 at the opposing point B of the delivery cylinder 3. The thin sheet P which is gripping-changed to the delivery grippers 6 is conveyed around the delivery cylinder 3, i.e., along the substantially arcuate convey path since the opposing point B of the transfer cylinder 1 and delivery cylinder 3 until the point C where the sprocket and the delivery chains 5 start to separate.

At this time, the thin-sheet guide surface 22 having the continuous arcuate section opposes the outer surface of the delivery cylinder 3 to be close to it. Thus, the instability of the sheet P is regulated by the Venturi effect of the air blown from the nozzle holes of the first and second movable guide members 7 and 12, so that the sheet P is conveyed stably without coming into contact with the thin-sheet guide surface 22. When the sheet P passes through the point C where the sprocket and the delivery chains 5 start to separate, the guide surfaces 13*a*, 14*a*, and 15*a* of the linear guide members 13, 14, and 15 oppose the delivery chains 5 to be close to them. Thus, the sheet P is linearly conveyed as it is guided by the guide surfaces 13*a*, 14*a*, and 15*a*.

A case wherein a printed thick sheet is to be guided will be described. In this case, prior to the printing operation, when the thickness of a sheet P is input to the sheet thickness input device 41 prior to printing, a sheet thickness signal 41*a* indicating the sheet thickness is input to the controller 40. The controller 40 determines the rotational speed of the stepping motor 38 in accordance with the input sheet thickness signal 41*a*, to move the driving rod 39 forward or backward into or from the gap between the blanket cylinder 33 and impression cylinder 31 corresponding to the sheet thickness.

Simultaneously, the controller 40 determines that the sheet P is a thick sheet based on the input sheet thickness signal 41*a*, and controls the solenoid valve units 11*b* and 21*b* to move the rods 11*a* and 21*a* of the air cylinders 11 and 21 backward. Thus, the guide surfaces 7*a* and 12*a* of the first and second movable guide members 7 and 12 oppose the outer surface of the delivery cylinder 3 to be spaced apart from it, as shown in FIG. 2. At this time, the stationary guide member 23 is located between the first and second movable guide members 7 and 12. Thus, the guide surfaces 7*a* and 12*a* together with the stationary guide surface 23*a* form the thick-sheet guide surface 24 having a continuous substantially arcuate section. The thick-sheet guide surface 24 opposes the outer surface of the delivery cylinder 3 to be spaced apart from it substantially throughout the entire sheet convey direction from upstream to downstream. As the first movable guide member 7 moves, the upstream end 7*b* of the first movable guide member 7 in the sheet convey direction moves close to the transfer cylinder 1.

As the movable lever 16 pivots, the guide surfaces 13*a*, 14*a*, and 15*a* of the linear guide members 13, 14, and 15 separate from the delivery chains 5 to be gradually farther from them downstream in the sheet convey direction. More specifically, the guide surfaces 13*a*, 14*a*, and 15*a*, while being continuous from the guide surface 12*a* of the second movable guide member 12, gradually move close to the delivery chains 5 downward in the sheet convey direction, and then become continuous to the guide surface 26*a* of the linear guide member 26. Thus, the guide surfaces 12*a*, 13*a*, 14*a*, 15*a*, and 26*a* form a non-step convey path.

In this state, when the printing operation is started, the sheet (thick sheet) P passes between the impression cylinders 31 and blanket cylinders 33 of the plurality of printing units of the printing unit 2 to be subjected to double-sided printing. After the printing, the sheet P is conveyed as it is gripped by the grippers of the transfer cylinder 1 located at the final end of the printing unit 2, and gripping-changed to the delivery grippers 6 at the opposing point B of the delivery cylinder 3. When the thin sheet P which is gripping-changed to the delivery grippers 6 is to be conveyed around the delivery cylinder 3, its trailing edge is largely separated from the delivery cylinder 3 by the centrifugal force. However, as the thick-sheet guide surface 24 opposes the delivery cylinder 3 to be spaced apart from it substantially throughout the entire sheet convey direction from upstream to downstream, the trailing edge of the sheet P will not come into contact with the thick-sheet guide surface 24. Also, as the end 7*b* of the first movable guide member 7 moves close to the transfer cylinder 1, the trailing edge of the sheet P will not collide against the end 7*b* or enter between the transfer cylinder 1 and end 7*b*.

As the stationary guide surface 23*a* together with the guide surfaces 7*a* and 12*a* forms the thick-sheet guide surface 24 which is continuous and opposes the outer surface of the delivery cylinder 3 to be spaced apart from it, the sheet P which is being conveyed around the delivery cylinder 3 will not come into contact with the thick-sheet guide surface 24. Thus, the sheet P is conveyed in a stable state, and its printing surface will not be damaged or rubbed.

Immediately after the sheet P passes through the point C where the sprocket and the delivery chains 5 start to separate, the trailing edge of the sheet P is spaced apart from the outer surface of the delivery cylinder 3 by the remaining centrifugal force. The guide surface 13*a* of the linear guide member 13 is also spaced apart from the outer surface of the delivery cylinder 3 and the delivery chains 5. Thus, the sheet P does not come into contact with the guide surface 13*a*. After that, the sheet P on which the centrifugal force no longer acts is guided along the convey path by the linear guide members 14, 15, 26, and 27 to be substantially in contact with the delivery chains 5.

At this time, the downstream end of the guide surface 15*a* in the sheet convey direction and the upstream end of the guide surface 26*a* in the sheet convey direction are close to each other to form no step between them. Thus, the conveyed sheet P does not collide against the upstream end of the guide surface 26*a* in the sheet convey direction. Therefore, damages or rubbing to the printing surface of the sheet P can be prevented, and the instability of the sheet can be prevented, so the sheet P can be conveyed smoothly.

Figure 4A:
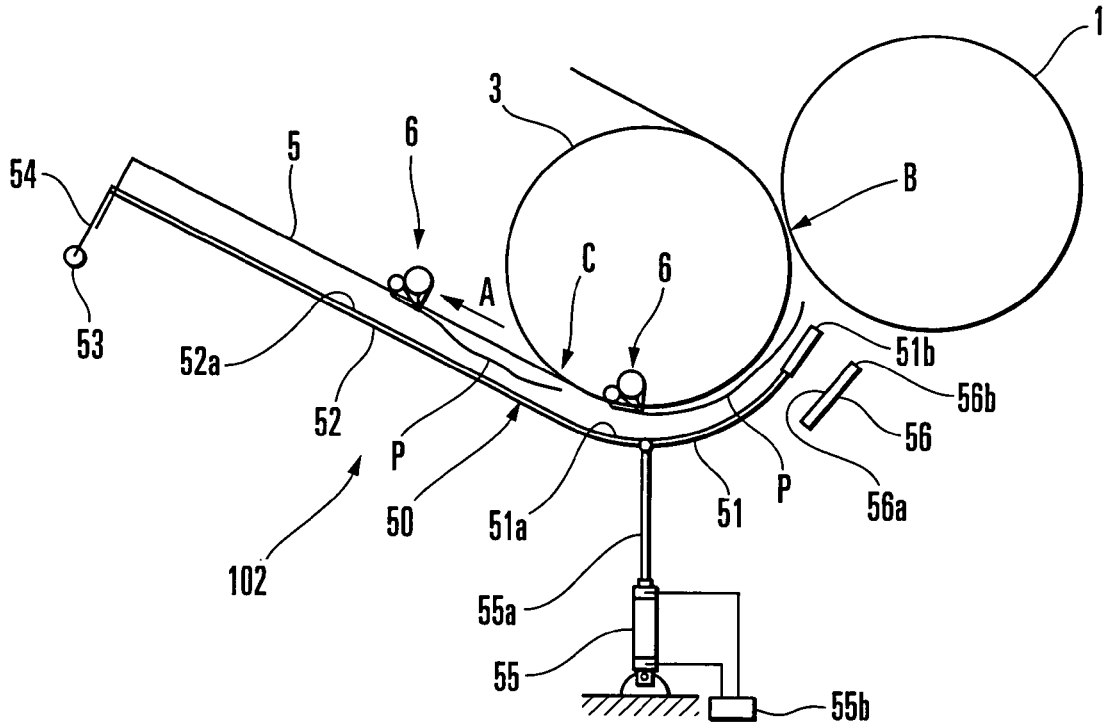
FIGS. 4A and 4B are views showing states wherein a sheet guide apparatus according to the second embodiment of the present invention guides a thin sheet and thick sheet, respectively.

The second embodiment of the present invention will be described with reference to FIGS. 4A and 4B. In FIG. 4A, an inverted-J-shaped movable guide member 50 integrally comprises a curved portion 51 and linear portion 52. The curved portion 51 has a guide surface 51*a* with an arcuate section having substantially the same curvature as that of the outer surface of an opposing delivery cylinder 3. The linear portion 52 is continuous to the curved portion 51 and has a linear guide surface 52*a*. The movable guide member 50 is swingably supported by a pivot shaft 53 which is connected to the downstream end of the linear portion 52 in the sheet convey direction and supported by delivery frames. An air cylinder 55 having a rod 55*a* is pivotally mounted on the delivery frames, and the rod 55*a* is connected to the center of the curved portion 51 of the movable guide member 50. Supply and discharge of pressurized air of the air cylinder 55 are controlled by a solenoid valve unit 55*b*.

When the rod 55*a* of the air cylinder 55 moves forward, the guide surface 51*a* of the curved portion 51 of the movable guide member 50 opposes the outer surface of the delivery cylinder 3 to be close to it. At this time, the guide surface 52*a* of the linear portion 52 opposes delivery chains 5 to be close to them, and an upstream end 51*b* of the curved portion 51 in the sheet convey direction moves close to a transfer cylinder 1. A stationary guide member 56 having a guide surface 56*a* is attached to the delivery frames, and the guide surface 56*a* opposes the outer surface of the delivery cylinder 3 to be spaced apart from it. In this case, only the guide surface 51*a* of the curved portion 51 of the movable guide member 50 forms a thin-sheet guide surface.

An upstream end 56*b* of the stationary guide member 56 in the sheet convey direction is arranged close to the transfer cylinder 1. The movable guide member 50 and stationary guide member 56 form a sheet guide structure 102.

Figure 4B:
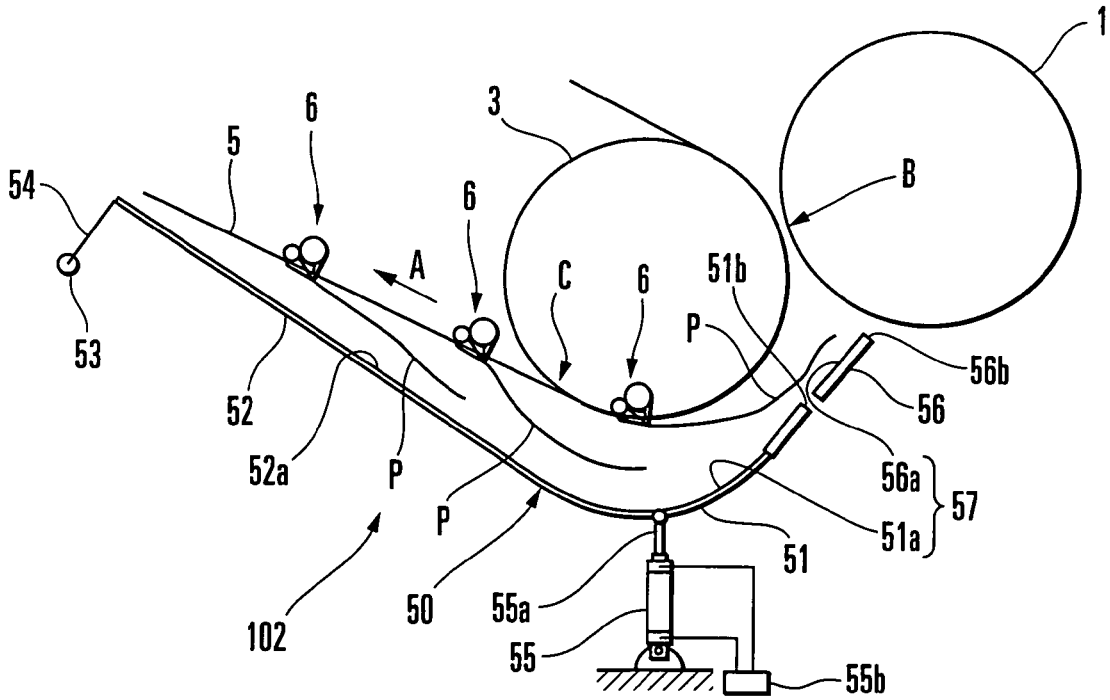

In this arrangement, when the rod 55*a* of the air cylinder 55 moves backward, the movable guide member 50 pivots clockwise in FIG. 4B about the pivot shaft 53 as the center, and the guide surface 51*a* of the curved portion 51 separates from the outer surface of the delivery cylinder 3. Thus, the end 51*b* of the curved portion 51 becomes adjacent to the stationary guide member 56, and the two guide surfaces 51*a* and 56*a* form a thick-sheet guide surface 57 having a continuous substantially arcuate section.

More specifically, when the movable guide member 50 separates from the delivery cylinder 3, the thick-sheet guide surface 57 is formed by one movable guide member 50 and one stationary guide member 56. Simultaneously, the stationary guide member 56 is positioned closer to the transfer cylinder 1 than the movable guide member 50. At this time, the guide surface 52*a* of the linear portion 52 which forms the movable guide member 50 opposes the outer surface of the delivery cylinder 3 to be spaced apart from it, and the guide surface 52*a* of the linear portion 52 separates from the delivery chains 5 to be gradually farther from them toward the delivery cylinder 3.

Sheet guide operation in the sheet guide apparatus having the above arrangement will be described. Prior to printing operation, when the thickness of a sheet P is input to a sheet thickness input device 41 prior to printing, a controller 40 checks whether the sheet P is a thick sheet or thin sheet. When the sheet P is determined to be a thin sheet, the controller 40 controls the solenoid valve unit 55*b* of the air cylinder 55 to move the rod 55*a* the air cylinder 55 forward. Thus, the guide surface 51*a* of the curved portion 51 of the movable guide member 50 opposes the outer surface of the delivery cylinder 3 to be close to it, as shown in FIG. 4A. Simultaneously, the end 51*b* of the curved portion 51 moves close to the transfer cylinder 1, and the guide surface 52*a* of the linear portion 52 opposes the delivery chains 5 to be close to them. The curved portion 51 and linear portion 52 blow air from their nozzle holes (not shown) in a direction (widthwise direction of the sheet) perpendicular to a traveling direction A of the sheet P.

In this state, when the printing operation is started, the sheet (thin sheet) P which has been printed on its two surfaces and conveyed is gripping-changed from the grippers of the transfer cylinder 1 to delivery grippers 6 at an opposing point B of the delivery cylinder 3. When the sheet P which is gripping-changed to the delivery grippers 6 is to be conveyed around the delivery cylinder 3, the guide surface 51*a* of the curved portion 51 opposes the outer surface of the delivery cylinder 3 to be close to it. Thus, the instability of the thin sheet P is regulated by the Venturi effect of the air blown from the nozzle holes of the curved portion 51, so that the sheet P is conveyed stably without coming into contact with the guide surface 51*a*. When the sheet P passes through a point C where the sprocket and the delivery chains 5 start to separate, the guide surface 52*a* of the linear portion 52 opposes the delivery chains 5 to be close to them. Thus, the sheet P is linearly guided as it is guided by the guide surface 52*a*.

A case wherein a printed thick sheet is to be guided will be described. In this case, prior to the printing, when the thickness of a sheet P is input to the sheet thickness input device 41 as a pre-preparation, the controller 40 determines that the sheet P is a thick sheet. The controller 40 then controls the solenoid valve unit 55*b* to move the rod 55*a* of the air cylinder 55 backward. Thus, the guide surface 51*a* of the curved portion 51 separates from the delivery cylinder 3 while opposing it, and the end 51*b* of the curved portion 51 becomes adjacent to the stationary guide member 56, so the two guide surfaces 51*a* and 56*a* form the thick-sheet guide surface 57 having a continuous substantially arcuate section. The thick-sheet guide surface 57 has substantially the same curvature as that of the delivery cylinder 3, and opposes the outer surface of the delivery cylinder 3 to be spaced apart from it. Simultaneously, the guide surface 52*a* of the linear portion 52 which forms the movable guide member 50 separates from the delivery chains 5 to be gradually farther from them toward the delivery cylinder 3.

In this state, when the printing operation is started, the sheet (thick sheet) P which has been printed on its two surfaces and conveyed is gripping-changed from the grippers of the transfer cylinder 1 to the delivery grippers 6 at the opposing point B of the delivery cylinder 3. When the sheet P which is gripping-changed to the delivery grippers 6 is to be conveyed around the delivery cylinder 3, its trailing edge is largely separated from the delivery cylinder 3 by the centrifugal force. As the thick-sheet guide surface 57 has substantially the same curvature as that of the delivery cylinder 3 and opposes the outer surface of the delivery cylinder 3 to be spaced apart from it, the sheet P is conveyed stably without coming into contact with the thick-sheet guide surface 57.

Also, as the end 56*b* of the stationary guide member 56 moves close to the transfer cylinder 1, the trailing edge of the sheet P will not collide against the end 56*b* or enter between the transfer cylinder 1 and the right end 56*b*. Thus, the printing surface of the thick sheet P can be prevented from being damaged or rubbed. Immediately after the thick sheet P passes through the point C where the sprocket and the delivery chains 5 start to separate, the trailing edge of the sheet P is still kept away from the delivery cylinder 3 by the remaining centrifugal force. As the guide surface 52*a* of the linear portion 52 is spaced apart from the delivery chains 5 to be gradually farther from them toward the delivery cylinder 3, the thick sheet P can be prevented from coming into contact with the guide surface 52*a*.

Figure 5A:
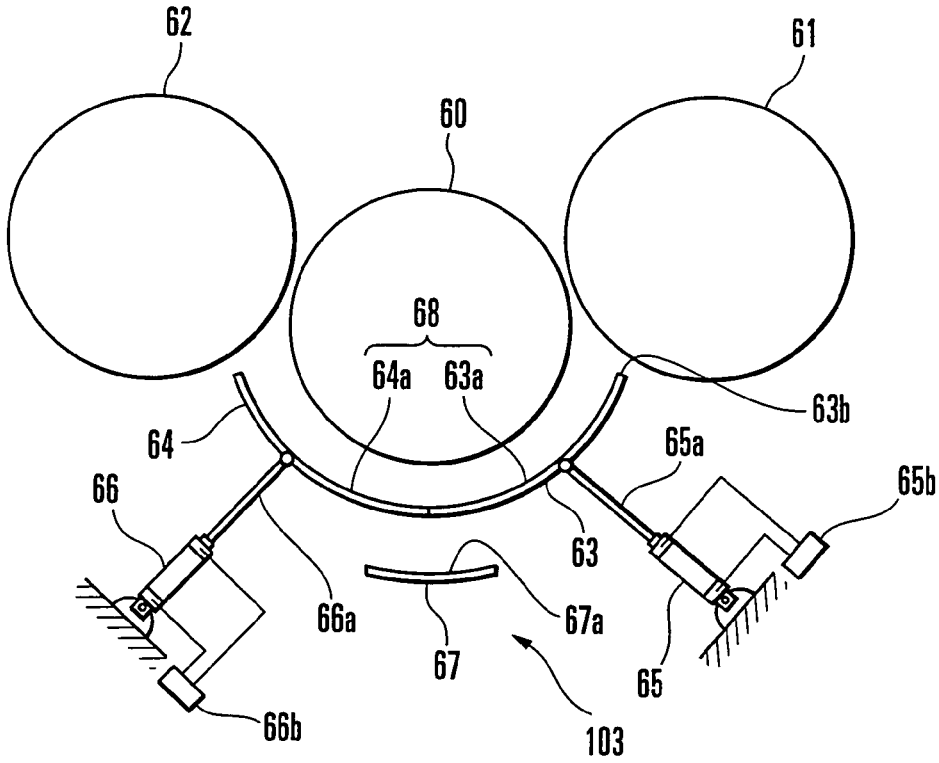
FIGS. 5A and 5B are views showing states wherein a sheet guide apparatus according to the third embodiment of the present invention guides a thin sheet and thick sheet, respectively.

The third embodiment of the present invention will be described with reference to FIGS. 5A and 5B. In FIG. 5A, a transfer cylinder 60 is arranged between two impression cylinders 61 and 62 to serve as a convey means which opposes each of the impression cylinders 61 and 62. First and second movable guide members 63 and 64 respectively having first and second guide surfaces 63*a* and 64*a* each with the same curvature as that of the outer surface of the transfer cylinder 60 are arranged to oppose the outer surface of the transfer cylinder 60. The cylinder ends of air cylinders 65 and 66 respectively having rods 65*a* and 66*a* are pivotally mounted on printing press frames, and the distal ends of the rods 65*a* and 66*a* of the air cylinders 65 and 66 are respectively pivotally mounted on the first and second movable guide members 63 and 64. Supply and discharge of pressurized air of the air cylinders 65 and 66 are controlled by solenoid valve units 65*b* and 66*b*.

When the rods 65*a* and 66*a* of the air cylinders 65 and 66 move forward, the first and second movable guide members 63 and 64 move close to the outer surface of the transfer cylinder 60. Simultaneously, the first and second movable guide members 63 and 64 move close to each other. Thus, the guide surface 63*a* of the first movable guide member 63 and the guide surface 64*a* of the second movable guide member 64 form a thin-sheet guide surface 68 having a continuous substantially arcuate section. The thin-sheet guide surface 68 opposes the outer surface of the transfer cylinder 60 to be close to it and has substantially the same curvature as that of the outer surface of the transfer cylinder 60. While the first and second movable guide members 63 and 64 are close to the outer surface of the transfer cylinder 60, an upstream end 63*b* of the first movable guide member 63 in the sheet convey direction moves close to the impression cylinder 61.

A stationary guide member 67 having a guide surface 67*a* with substantially the same curvature as that of the outer surface of the transfer cylinder 60 is fixed to the printing press frames. When both the rods 65*a* and 66*a* of the air cylinders 65 and 66 move backward and both the first and second movable guide members 63 and 64 separate from the outer surface of the transfer cylinder 60, as shown in FIG. 5B, the stationary guide member 67 is located between the first and second movable guide members 63 and 64. In this state, the guide surface 67*a* of the stationary guide member 67 together with the guide surfaces 63*a* and 64*a* of the first and second movable guide members 63 and 64 forms a thick-sheet guide surface 69 having a continuous substantially arcuate section. The thick-sheet guide surface 69 has the same curvature as that of the outer surface of the transfer cylinder 60, and opposes the outer surface of the transfer cylinder 60 to be spaced apart from it. When both the first and second movable guide members 63 and 64 separate from the transfer cylinder 60, the end 63*b* of the first movable guide member 63 moves close to the impression cylinder 61. The first and second movable guide members 63 and 64 and the stationary guide member 67 form a sheet guide structure 103.

In this arrangement, when a thin sheet is to be guided, the solenoid valve units 65*b* and 66*b* are controlled to move the rods 65*a* and 66*a* of the air cylinders 65 and 66 forward, as shown in FIG. 5A. Thus, the first and second movable guide members 63 and 64 move close to the outer surface of the transfer cylinder 60 to form the thin-sheet guide surface 68. The thin-sheet guide surface 68 has substantially the same curvature as that of the outer surface of the transfer cylinder 60, and opposes the outer surface of the transfer cylinder 60 to be close to it. Simultaneously, the end 63*b* of the first movable guide member 63 moves close to the impression cylinder 61. Therefore, the instability of the thin sheet, which is gripping-changed from the grippers of the impression cylinder 61 to the grippers of the transfer cylinder 60 and to be conveyed along the substantially arcuate convey path around the impression cylinder 61, is regulated by the Venturi effect of the air blown from the nozzle holes of the first and second movable guide members 63 and 64, so that the thin plate is conveyed stably without coming into contact with the thin-sheet guide surface 68.

Figure 5B:
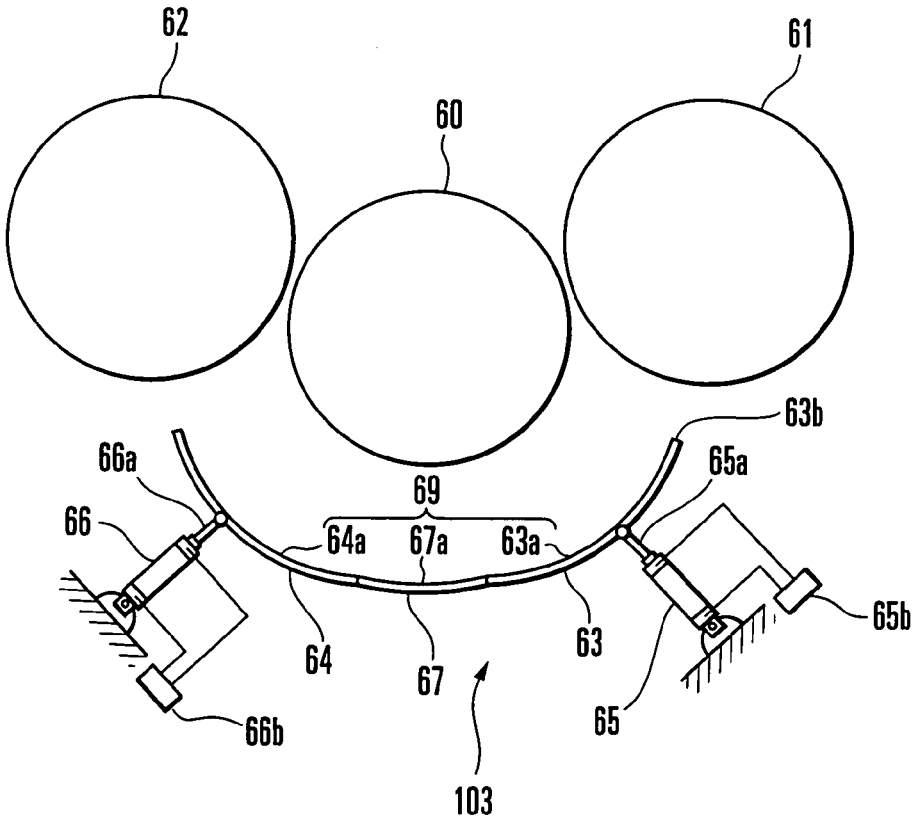

When a thick sheet is to be guided, the solenoid valve units 65*b* and 66*b* are controlled to move the rods 65*a* and 66*a* of the air cylinders 65 and 66 backward, as shown in FIG. 5B. Thus, the first and second movable guide members 63 and 64 separate from the outer surface of the transfer cylinder 60 to form the thick-sheet guide surface 69. The thick-sheet guide surface 69 has substantially the same curvature as that of the outer surface of the transfer cylinder 60, and opposes the outer surface of the transfer cylinder 60 to be spaced apart from it. Simultaneously, the end 63*b* of the first movable guide member 63 moves close to the impression cylinder 61.

According to this embodiment, when the thick sheet which is gripping-changed from the grippers of the impression cylinder 61 to the grippers of the transfer cylinder 60 is to be conveyed around the transfer cylinder 60, its trailing edge is largely separated from the outer surface of the transfer cylinder 60 by the centrifugal force. The thick-sheet guide surface 69 has substantially the same curvature as that of the outer surface of the transfer cylinder 60, and opposes the outer surface of the transfer cylinder 60 to be spaced apart from it. Therefore, the thick sheet is conveyed stably without coming into contact with the thick-sheet guide surface 69. The end 63*b* of the first movable guide member 63 is close to the impression cylinder 61. Thus, the trailing edge of the sheet does not collide against the end 63*b* or enter between the impression cylinder 61 and end 63*b*. The printing surface of the thick plate can accordingly be prevented from being damaged or rubbed.

In the respective embodiments described above, the stationary guide surfaces 23*a*, 56*a*, and 67*a* of the stationary guide members 23, 56, and 67 need not always be arcuate surfaces but can be flat surfaces. Although a case has been described wherein the printing target is a sheet, the printing target can be a film-type sheet.

As has been described above, according to the present invention, the printing surface can be prevented from being damaged or rubbed. As the sheet separated from the convey means does not come into contact with the guide surface, the printing surface on the reverse side of the sheet can be prevented from being damaged or rubbed.

What is claimed is:

1. A sheet guide apparatus comprising:

a transport cylinder which holds and conveys a sheet;

convey means for holding the sheet received from said transport cylinder and conveying the sheet along a first convey path which is at least substantially arcuate; and a sheet guide structure which guides the sheet conveyed by said convey means, said sheet guide structure comprising movable guide means which is movable between positions close to and spaced apart from said first convey path and stationary guide means which is stationarily arranged at a position spaced apart from said first convey path, wherein when said movable guide means is close to said first convey path, said movable guide means is located at a position nearer to the first convey path than said stationary guide means is to said first convey path and the sheet is guided by only said movable guide means, a first guide surface having a continuous substantially arcuate section is formed by only said movable guide means, and when said movable guide means is spaced apart from said first convey path, a second guide surface having a continuous substantially arcuate section is formed by said movable guide means and said stationary guide means.

2. An apparatus according to claim 1, wherein said movable guide means comprises a first movable guide member and a second movable guide member which are sequentially arranged from upstream to downstream in a sheet convey direction, and said stationary guide means comprises a stationary guide member which is arranged between said first movable guide member and second movable guide member spaced apart from said first convey path.

3. An apparatus according to claim 2, further comprising first driving means for driving said first movable guide member in directions to be close to and spaced apart from said first convey path, and second driving means for driving an upstream side of said second movable guide member in the sheet convey direction in directions to be close to and spaced apart from said second convey path.

4. An apparatus according to claim 2, wherein said convey means conveys the sheet along a linear second convey path after said first convey path, and said second movable guide member is supported such that a downstream side thereof in the sheet convey direction is arranged at a position close to said second convey path and that an upstream side thereof in the sheet convey direction is movable between positions close to and spaced apart from said second convey path.

5. A sheet guide apparatus comprising:

a transport cylinder which holds and conveys a sheet;

convey means for holding the sheet received from said transport cylinder and conveying the sheet along a first convey path which is at least substantially arcuate; and a sheet guide structure which guides the sheet conveyed by said convey means, said sheet guide structure comprising movable guide means which is movable between positions close to and spaced apart from said first convey path and stationary guide means which is stationarily arranged at a position spaced apart from said first convey path, wherein when said movable guide means is close to said first convey path, a first guide surface having a continuous substantially arcuate section is formed by only said movable guide means;

when said movable guide means is spaced apart from said first convey path, a second guide surface having a continuous substantially arcuate section is formed by said movable guide means and said stationary guide means;

said movable guide means comprises a first movable guide member and a second movable guide member which are sequentially arranged from upstream to downstream in a sheet convey direction;

said stationary guide means comprises a stationary guide member which is arranged between said first movable guide member and second movable guide member spaced apart from said first convey path;

said convey means conveys the sheet along a linear second convey path after said first convey path;

said second movable guide member is supported such that a downstream side thereof in the sheet convey direction is arranged at a position close to said second convey path and that an upstream side thereof in the sheet convey direction is movable between positions close to and spaced apart from said second convey path; and said second movable guide member is supported to be pivotal about a downstream side thereof in the sheet convey direction as the center.

6. A sheet guide apparatus comprising:

a transport cylinder which holds and conveys a sheet;

convey means for holding the sheet received from said transport cylinder and conveying the sheet along a first convey path which is at least substantially arcuate; and a sheet guide structure which guides the sheet conveyed by said convey means, said sheet guide structure comprising movable guide means which is movable between positions close to and spaced apart from said first convey path and stationary guide means which is stationarily arranged at a position spaced apart from said first convey path, wherein when said movable guide means is close to said first convey path, a first guide surface having a continuous substantially arcuate section is formed by only said movable guide means;

when said movable guide means is spaced apart from said first convey path, a second guide surface having a continuous substantially arcuate section is formed by said movable guide means and said stationary guide means;

said movable guide means comprises a first movable guide member and a second movable guide member which are sequentially arranged from upstream to downstream in a sheet convey direction;

said stationary guide means comprises a stationary guide member which is arranged between said first movable guide member and second movable guide member spaced apart from said first convey path;

said convey means conveys the sheet along a linear second convey path after said first convey path;

said second movable guide member is supported such that a downstream side thereof in the sheet convey direction is arranged at a position close to said second convey path and that an upstream side thereof in the sheet convey direction is movable between positions close to and spaced apart from said second convey path; and said second movable guide member has a guide surface with a substantially arcuate section which opposes said first convey path and a guide surface with a linear section which opposes said second convey path.

7. An apparatus according to claim 6, wherein said first movable guide member has a guide surface with a substantially arcuate section which opposes said first convey path.

8. An apparatus according to claim 6, wherein when a sheet to be conveyed by said convey means comprises a thin sheet, said guide surfaces of said second movable guide member oppose said first and second convey paths to be parallel thereto.

9. An apparatus according to claim 1, further comprising:

driving means for moving said movable guide means in directions to be close to and spaced apart from said first convey path;

a sheet thickness input device to which a sheet thickness is to be input; and a controller which controls said driving means in accordance with a sheet thickness signal from said sheet thickness input device.

10. A sheet guide apparatus comprising:

a transport cylinder which holds and conveys a sheet;

convey means for holding the sheet received from said transport cylinder and conveying the sheet along a first convey path which is at least substantially arcuate; and a sheet guide structure which guides the sheet conveyed by said convey means, said sheet guide structure comprising movable guide means which is movable between positions close to and spaced apart from said first convey path and stationary guide means which is stationarily arranged at a position spaced apart from said first convey path, wherein when said movable guide means is close to said first convey path, a first guide surface having a continuous substantially arcuate section is formed by only said movable guide means, and when said movable guide means is spaced apart from said first convey path, a second guide surface having a continuous substantially arcuate section is formed by said movable guide means and said stationary guide means, wherein said stationary guide means is arranged upstream of said movable guide means spaced apart from said first convey path in a sheet convey direction.

11. An apparatus according to claim 1, wherein when a sheet to be conveyed by said convey means is thin, said movable guide means is located close to said first convey path; and when a sheet to be conveyed by said convey means is thick, said movable guide means is located apart from said first convey path.

12. A sheet guide apparatus comprising:

a transport cylinder which holds and conveys a sheet;

convey means for holding the sheet received from said transport cylinder and conveying the sheet along a first convey path which is at least substantially arcuate; and a sheet guide structure which guides the sheet conveyed by said convey means, said sheet guide structure comprising movable guide means which is movable between positions close to and spaced apart from said first convey path and stationary guide means which is stationarily arranged at a position spaced apart from said first convey path, wherein when said movable guide means is close to said first convey path, said movable guide means is located at a position nearer to the first convey path than said stationary guide means is to said first convey path and the sheet is guided by only said movable guide means, a first guide surface having a continuous substantially arcuate section is formed by only said movable guide means;

when said movable guide means is spaced apart from said first convey path, a second guide surface having a continuous substantially arcuate section is formed by said movable guide means and said stationary guide means; and wherein said movable guide means comprises a first movable guide member and a second movable guide member which are sequentially arranged from upstream to downstream in a sheet convey direction;

said stationary guide means comprises a stationary guide member which is arranged between said first movable guide member and second movable guide member spaced apart from said first convey path;

said apparatus further comprising a driving means for moving said movable guide means in directions to be close to and spaced apart from said first convey path;

a sheet thickness input device to which a sheet thickness is to be input; and a controller which controls said driving means in accordance with a sheet thickness signal from said sheet thickness input device.

* * * * *